United States Patent [19]

Eickmann

[11] Patent Number: 4,681,023

[45] Date of Patent: Jul. 21, 1987

[54] SLIDE BEARING PORTIONS ON OUTER FACES OF PISTON SHOES

[76] Inventor: Karl Eickmann, 2420 Isshiki, Hayama-machi, Kanagawa-ken, Japan

[21] Appl. No.: 782,633

[22] Filed: Sep. 30, 1985

Related U.S. Application Data

[63] Continuation-in-part of Ser. No. 530,178, Sep. 9, 1983, abandoned, which is a continuation-in-part of Ser. No. 122,914, Feb. 19, 1980, abandoned, which is a continuation-in-part of Ser. No. 954,555, Oct. 25, 1978, abandoned.

[51] Int. Cl.[4] ..... F01B 13/06

[52] U.S. Cl. ..... 91/488

[58] Field of Search ..... 91/488, 491

[56] References Cited

U.S. PATENT DOCUMENTS

| | | | |
|---|---|---|---|
| 3,793,923 | 2/1974 | Smith | 91/488 |
| 3,948,149 | 4/1976 | Fricke | 91/488 |
| 4,212,230 | 7/1980 | Eickmann | 91/488 |
| 4,258,548 | 3/1981 | Hall | 91/490 |
| 4,420,986 | 12/1983 | Nakayama | 74/60 |

*Primary Examiner*—Carlton R. Croyle
*Assistant Examiner*—Paul F. Neils

[57] ABSTRACT

On piston shoes in radial piston pumps, motors and engines the radial load which is excerted by the pressure under the piston onto the piston shoe is to a high rate borne by hydrostatic bearings between the piston shoe and the inner guide face of the piston stroke actuator ring. At high revolutions per given time the centrifugal forces appearing from the masses of piston and shoe increase drastically which results therein, that the bearing capacity of the hydrostatic bearing fails to bear the increased load. The invention gives rules how additional hydrodynamic bearing portions can become provided on the outer portions of the piston shoes, whereby those portions will carry an additional load by hydrodynamic actions. Since the bearing capacity of such bearing portions increases with increase of the rotary speed of the device, the applicable range of revolutions per minute can be increased by the application of the invention.

3 Claims, 15 Drawing Figures

SLIDE BEARING PORTIONS ON OUTER FACES OF PISTON SHOES

REFERENCE TO RELATED APPLICATIONS

This application is a continuation in part application of my co-pending patent application Ser. No. 530,178 now abandoned, which was filed on 09-09-83 as a continuation in part application of my now abandoned earlier application Ser. No. 122,914 which was filed on 02-19-1980 and which was a continuation in part application of my still earlier Pat. application, Ser. No. 954,555 which was filed on 10-25-1978 and which is now also abandoned and which is now regarding the not abandoned Figures U.S. Pat. No. 4,358,073 which issued on Nov. 09, 1982. Benefits of the above mentioned applications are at least partially claimed for this present continuation in part application.

BACKGROUND OF THE INVENTION

1. Field of the invention

This invention relates to improvements of the outer faces of piston shoes of radial piston pumps, motors, transmissions, compressors and engines. Such outer faces slide along the inner face of a piston stroke actuator or guide ring. The outer faces of the piston shoes of the invention and of the field in the art, commonly have hydrostatic bearings to carry a radial load. The present invention deals with the improvement of those portions of the outer faces of piston shoes which supply in addition to the hydrostatic bearing capacity and in addition to probable smaller hydrodynamic bearing capacities an improved hyrodynamic bearing capacity.

2. Description of the prior art

The application of hydrostatic bearings in the outer faces of piston shoes which are also called slide faces of piston shoes has obtained a high perfection, as is for example known from my U.S. Pat. No. 4,212,230.

Hydrodynamic bearing portions are also already known, for example, from my U.S. Pat. No. 4,037,523. Related to the art are also U.S. Pat. Nos. 4,018,137, 4,258,548, French Pat. No. 197,810 or others. The mentioned French patent deals with axial pistons and can carry a load hydrodynamically only around a point. The obtained bearing capacity is therefore, almost neglectible, small. U.S. Pat. No. 4,018,137 has a slide face which is parallel to the guide face of the piston stroke guide. Parallel faces can not create effective hydrodynamic bearing capacity. This patent thereby errs when it assumes that the piston shoe would carry a considerable radial load by hydrodynamic bearing action. U.S. Pat. No. 4,258,548 provides or attempts to provide hydrodynamic bearing portions but fails to separate them from the hydrostatic bearing portion. The effects and results of the actions are, thereby, not exactly known. They interfere with each other. A maximal result of bearing capacity can not be obtained. My U.S. Pat. No. 4,037,523 and the other mentioned patents, as well as other patents in the art, fail to give teachings how to obtain the desired effects. They can, therefore, also not obtain the desired effective results. The defects of the former art shall be overcome or become reduced by the present invention.

SUMMARY OF THE INVENTION

The object of the invention is, to provide a piston shoe in radial piston devices which slides with its outer face along the inner face of a piston stroke guide ring, whereat the outer face of the piston shoe has unloading separation recesses between the hydrostatic bearing portion and a respective hydrodynamic bearing portion, while the hydrodynamic bearing portion is so dimensioned and configurated, that it obtains an optimum of hydrodynamic bearing capacity where the radial load onto the piston shoe by centrifugal forces of masses will exceed the bearing capacity of the hydrostatic bearing portion.

Thereby it is an object of the invention, to increase the speed range of the piston shoe to permit a greter range of rotary revolutions per minute to the device which employs the piston shoe of the invention.

Further objects of the invention will become apparent from the drawings, from the description of the preferrd embodiments and from the claims. The claims are considered to be a porion of the disclosure of the present application.

BRIEF DESCRIPTION OF THE DRAWINGS

FIGS. 1 and 2 show the common arrangement of a piston and piston-shoe assembly. FIG. 1 is a longitudinal sectional veiw through the medial line of FIG. 2. Piston 53 carries the piston shoe 52. Piston shoe 52 is pivotably borne on piston 53. The outer face 50 slides along the inner face of the piston stroke actuator as known from a number of radial piston devices patents. A passage 54 leads pressure fluid from the respective cylinder of the machine through piston 53 and through piston shoe 52 into the fluid pressure pocket 55 in the outer face 50 of the piston shoe. A sealing land 56 surrounds the fluid pressure pocket 55 and thereby forms with said pocket 55 a hydrostatic bearing, as known in the art. Also known in the art, for example from my U.S. Pat. No. 3,223,046 is to set unloading recesses 57 outwards of the sealing lands to limit the extension of the sealing lands 56.

Endwards of the unloading recesses 57 remained guide portions with outer guide faces 50, in the former art. These faces 50, however, were parallel to the piston stroke actuator guide faces and could therfore not built up sufficient hydrodynamic pressures to prevent contact between the faces and welding between them.

It should be understood, that there are different kinds of piston-shoes. Those which act with "inter-static" bearings, as FIG. 6 of my U.S. Pat. No. 3,951,047 and those, which require an hydrodynamic action for speedy slide along other face, such as my piston shoe of FIG. 11 of my U.S. Pat. No. 3,951,047. The present invention deals only with those piston shoes, which require an hydrodynamic action in addition to the hydrostatic bearing of pocket 55 and sealing lands 56.

Figure 1:
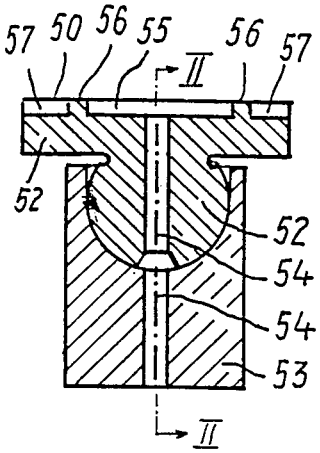
FIG. 1 is a longitudinal sectional view through an embodiment of the invention.

The difficulties of too little or no hydrodynamic action of the former art are overcome by the provision of the inclined face portions 51 of FIG. 1 and of FIGS. 2 to 6.

Thus, according to the invention, there are provided guide face portions 50 provided parallel to the guide face 63 of the stroke actuator face with radius 61 substantially equal to the radius of the guide face 63 in order to guide the piston shoe accurately along the actuator guide face and there are added, by this invention, the inclined face-portions 51. These are slightly inclined relatively to the guide face of the piston stroke actuator and they narrow relative to said actuator guide face contrary to the direction of relative movement. Thus, fluid enters at the wider distanced piston shoe end into the inclined, key-like space between the piston shoe and the actuator guide face over the inclined face portion(s) 51.

At further movement of the piston shoe along the actuator guide face the fluid enters the narrowing key-space over the inclined face portion(s) 51 and thereby compresses. Since only a portion of the entered fluid can escape laterally or in other directions, a pressure builds up in the key-formed space over the inclined face portion(s) 51. This is an hydrodynamic pressure and prevents the welding between the relatively to each other moving faces, because it is able to carry a load and able to maintain a desired clearance between face portion 50 and the respective guide face 63 of the piston stroke actuator.

The dimension of angle between face portions 51 and the actuator guide face as well as the dimensions of length and width of the inclined face portion(s) 51 together with the size of the relative speed between the relatively to each other moving faces will define the total force of the hydrodynamic action onto the face portion(s) 51. Consequently, the face portions 51 of the invention must be designed and machined accordingly. Since they can not create a very high hydrodynamic pressure developing capacity, the main load must be borne by the hydrostatic bearing. Only a small portion of the radial load of the piston shoe can be carried by the inclined face portions 51.

It is further a fact, that a considerable hydrodynamic pressure development capability can be obtained only with very small inclinations of the inclined face portions 51. Because if the key-angle between the relatively to each other moving faces is too big, the entered fluid can escape forward in the direction of movement out of the key-space, since, if the angle is too big, there would not be enough friction in fluid to keep the fluid within the key-space. No sufficient hydrodynamic pressure could then develope. Thus, in practical application, the inclination reaches a maximum of one or a very few hundredth or thousandth of a millimeter distance 51 at the outer end of the piston shoe and between the end portion of portion 51 and the actuator guide face. The machining of such small angle and distance in the required accuracy is very difficult and so is the control of the dimensions thereof.

Accordingly, by this invention, the inclined face portions 51 are so formed and dimensioned, that they can be easily made. The process of building the inclined face portions 51 is therefore also an important part of this invention.

A most simple and convinient way to produce the inclined faceportion(s) 51 is, according to the invention, to insert for example by hand or holder, a piston shoe of the outer radius 61 of outer guide face face 51 into a cylinder portion with an inner face of radius 62 egual to the desired radius of the inclined face portion(s) 51.

By putting a lapping powder between the faces, the assembly man can easily lapp the outer face of the piston shoe, namely face 50 along the inner face 63 of the cylinder portion . The lapping powder gives another color to the lapped portion of face 50. Thereby the assembly man can see and recognize, how far the lapping action has taken place. The length of lapping—in other words, the changed color of the face 50—shall correspond to the length 51 of FIG. 4 or 516 of FIG. 3. As long as the colored length is shorter than the measure 51, the piston shoe is not enough lapped and the lapping should be continued until the length 51 is reached. After such length 51 is reached, the configuration of radius 62 of the face 63 of the part-clindrical lapping tool has produced a very exactly as desired inclined face portion 51 to create the desired hydrodynamic action between the piston shoe and the guide face of the actuator.

In mass production the described hand-production process may be replaced by cutters or grinders with the desired radius 62. The radius 62 has to be defined by design of the piston shoe in order to obtain the desired extent of build-up of the desired hydrodynamic pressure between the piston shoe outer face and the actuator guide face.

FIGS. 2 to 6 demonstrate samples of applications of the inclined face portions 51 of the invention on several different piston shoe types. FIGS. 3 to 6 are views from above upon the guide faces 50 of the respective piston shoe. All face portions 51 of said Figures can be produced as described above. At hand-lapping the ends of the piston shoes will concentrate themselves in the lapping cylinder on face 63 by putting pressure onto the medial portion of the piston shoe. The lapping of the inclined faces 51 and the production of the inclined face portions 51 will thereby be accurate.

Figure 3:
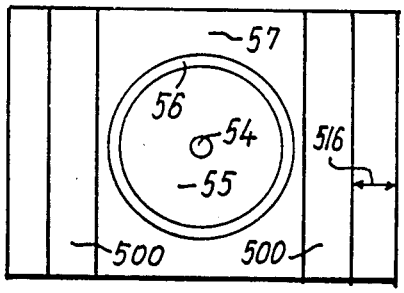
FIG. 3 is a view from above onto the shoe of FIG. 2.

In FIG. 3 the piston shoe obtains two inclined face portions 51 on the ends of the rectangular piston shoe outer face.

Figure 4:
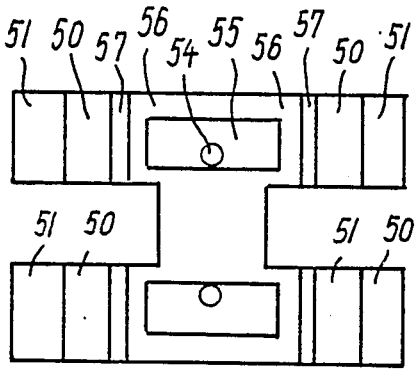
FIG. 4 is a view from above onto a shoe of another embodiment.

In FIG. 4 the "H-formed"—deep diving piston shoe obtains four inclined face portions 51 on the ends of the H-guide portions.

Figure 5:
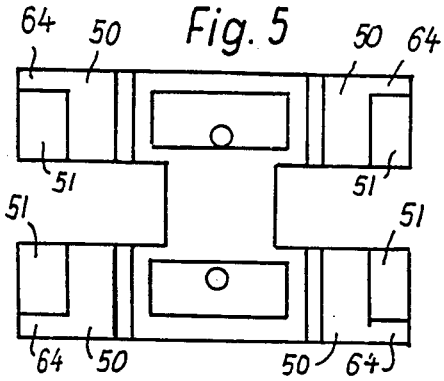
FIG. 5 is a view from above onto a shoe of a further embodiment.

In FIG. 5 the inclined face portions 51 are shortened, in order that guiding portions 64 of guide faces 50 remain for the purpose of maintaining a long guide of the piston shoe along the actuator face. To produce the shortened inclined portions 51 the cylindrical tool with radius 62 has to be shorter in the direction of the rotor axis of the machine, than the respective piston shoe is.

Figure 6:
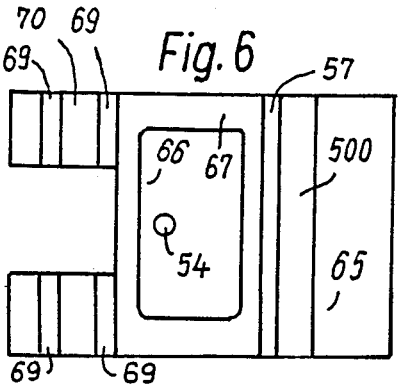
FIG. 6 is a view from above onto another embodiment.

In FIG. 6 the forwardly extended piston shoe of my U.S. Pat. Nos. 3,967,540 and 4,075,932 becomes an extended inclined face portion 51 in the forward direction of movement in order to build up a very considerably high hydrodynamic fluid pressure to make it capable of running with very high relative speed along a stationary actuator guide face of the machine.

In the direction contrary to the direction of movement the piston shoe of this forwardly extended type does not need a strong hydrodynamic action. Consequently the piston shoe of FIG. 6 may on the other end be provided with the slot 68 for the reception of the rotor segments of said patents. The guide face 50 may then on this end be provided with unloading recesses 69 whereby guide face portions 70 are formed at this portion of guide face 50.

For the detailed calculation of the relative inclinations of the exact angles of relative inclination at the respective distances from the axis of the respective piston, namely the angles of inclination between the face portions 51 and the guide face(s) 63 and thereby the relative distances between these faces at the respective locations, the handbooks of the inventor my be read or the respective Rotary Engine Kenkyusho Reports of Rotary Engine Kenkyusho, 24120 Isshiki, Hayama-machi, Kanagawa-Ken, Japan, may be studied. Otherwise the rules of hydrodynamic bearing capacities may apply and these can be found in for example, the following books:

1. "Theory and practice of lubrication for engineers", written by Mr. Fuller and published by Wiley and Sons of New York;
2. "Lubrication of bearings", written by Mr. Radzimovski and published by The Ronald Press, also residing in the City of NEW YORK.

There are more books in the field. But they are often of a highly mathematical and scientific nature and exceed the need for the common artisan in the field. Generally best and satisfactory informations are obtainable for rather small costs from the books of the Schaum Publishing Company of New York. This concerns mathematics as well as engineering and mechanics as well as fluid mechanics. However, regrettably the book "Hydraulics and Fluid Mechanics" of this publishing company, written by Ronald V. Giles, does not have a specific chapter of hydrodynamic bearings.

The invention of FIGS. 1 to 6 has herebefore been described in terms of terminology as they are presently used by the artisans in the field. For a better understanding of the invention in FIGS. 1 to 6 an understanding of the geometric mathematical appearances might enhance the work with the invention in practical application. It is therefore described in the following, what geometrical and mathematical matters are of importance in the invention. Accordingly in the following description of the invention, there will appear radii and axes as well as gaps and extensions. The gaps and extension faces will have inner and outer ends.

Figure 2:
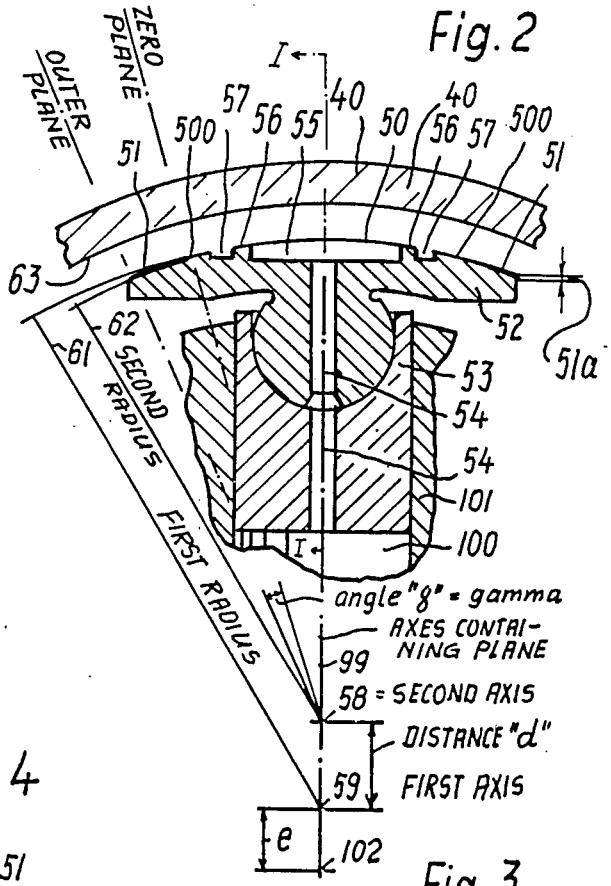
FIG. 2 is a cross sectional view through FIG. 1 along the line II -II.

Looking at FIG. 2, the first axis will be the referential 59. The second axis will be the referential 58. The distance "d" between these axes shown by the referential 611. The first radius is shown by referential 61 and the second radius is demonstrated by referential 62. The inclined face portions of the previous description in terminology of the artisans will in the following description in geometric-mathematical terminology be called "extension faces 51". The outer faces 50,51 of the piston shoes 52 are thereby divided into slide faces 50 and extension faces 51. The piston shoe portions endwards of the slide faces 50 and of the separating recesses or unloading recesses 57 are hereafter called: "extensions".

The invention of FIGS. 1 to 6 then corresponds to the following definitions:

First definition

An improvement on the outer slide faces 50 of piston shoes 52 in radial piston fluid flow facilitating devices, such as pumps, motors, compressors, transmissions, wherein the slide faces are the radial end faces of the piston shoes and are sliding along at least one respective guide face(s) 63 of the piston stroke actuator 163 of the device, while the guide face(s) 63 is (are) of cylindrical configuration of a first radius 61 around a first axis 59 and thereby an annular guide face 63, the outer faces 50 are at least partially substantially complementary configurated respective to portions of the annular guide face 63 and wherein the slide faces of the piston shoes are interrupted by recesses 55 which form fluid pressure pockets 55 which are filled with an interior fluid from fluid containing cylinders 100 through passages 54 to constitute with their surrounding sealing lands 56 hydrostatic bearing portions 55, 56, as known in the art, and the improvement provides novelties, wherein the slide faces 50 form medial portions 55 which contain the hydrostatic bearings 55, 56 and are substantially part-cylindrically with the first radius 61 around the first axis 59, wherein the slide faces 50 and the piston shoes 52 have extensions 51, 152, endwards of the medial portions in the direction of the movements of the piston shoes, wherein separating recesses 57 are provided between the sealing lands 56 of the hydrostatic bearings and the extensions 51, 152 and, wherein the extensions include extension face portions 51 of a second radius 62 around a second axis 58 which is parallely distanced from the first axis, whereby the extension face portions 51 with the second radius 62 form with portions of the annular guide face 63 gaps which have outer ends and inner ends with the inner ends near to the separating recesses 57 and the outer ends remote from the separating recesses 57 while the gaps are radially wider at the outer ends but narrower at the inner ends with the radial width gradually decreasing from the outer ends towards the inner ends whereby exterior fluid can enter into the gaps at their outer ends when the extensions 51 of the slide faces 50 of the piston shoes 52 move through exterior fluid substantially along the annular guide face(s) 63 and the relative velocity between the extensions of the slide faces and the annular guide face draws the exterior fluid into the gap while the viscosity in the fluid provides a resistance against escape of the fluid from the gaps whereby a pressure is built up in the gaps and the pressure increases with the nearness to the inner ends of the gaps and of the extension face portions 51 with the second radius 62, while the pressure in the gaps is utilized to provide a bearing action between the actuator's annular guide face portions 63 and the extension face portions 51 of the piston shoes 52.

2nd definition

21. The improvement of of the first definition, wherein the piston shoes 52 are pivotably borne on pistons 53 which are arranged and reciprocating in substantially radial cylinders 100 of rotors 101 of the fluid flow facilitating devices, wherein the rotors 101 are revolvingly borne in a housing and form third axes 102 which are axes of rotation of the rotors 101, wherein the first axes 59 are parallel to the third axes 102 but distanced from the third axes by an eccentricity which is defined by the letter "e", wherein an axes containing imaginary medial plane 99 is considered through the actuator 163 and through the respective rotor 101 of the rotors, while the imaginary plane 99 contains the first and third axes 58, 102, wherein the imaginary plane 99 defines the rotary angle zero of the axis of the respective piston 53 when one of the pistons locate with its axis in the imaginary plane, while every other pistons forms rotary angles of the value "alpha" between their respective piston axes and the medial plane, wherein the width of the gap between the guide face portions 63 and the extension face portions 51 are defined by the letter "W", wherein imaginary radial planes are imaginable and calculable from the second axis 58 through the gaps, wherein one of the imaginary radial planes of a respective gap of the gaps defines a zero plane extending from the respective second axis 58 of the second axis through the respective inner end of the respective gap of the gaps, wherein an angle defined by the letter "gamma" appears between zero plane and another plane of the imaginary radial planes, wherein the respective second radius 62 of the second radius is defined by the letter "r" while the respective first radius of first radius is defined by the letter "R", wherein the length of the respective extension face portion 51 of extension face portions between the zero plane and the another plane of the imaginary radial planes is defined by the letter "L" and calculable by the equation $$L=2rpi\ gamma/360$$

with pi=3,14 and "gamma" in degrees, wherein the width "W" corresponds to the equation $$W=d\cos gamma+R-r-(d^2/2R)\sin^2 gamma,$$

wherein the respective imaginary radial plane through the respective outer end of the respective gap of the gaps defines the outer width of the respective gap and thereby the greatest width of the respective gap defined by the letters "Wg", wherein the greatest width "Wg" defines together with the relative speed between the extension face portion 51 and the respective portion of the annular guide face portions 63 and together with the axial breadth "B" of the extension face portion 51 the amount of inflow of fluid which is drawn into the gap, the axial breadth "B", the viscosity of the exterior fluid and the respective different values of the local width "W" define the resistance to outflow of fluid from the gap, and, wherein the pressure in the gap is obtained from the equilibrium of the inflow and of the outflow of fluid into and out of the gap whereby the outflow is defined by the pressure, the viscosity, the respective local length and breadth of the length "L" and of the breadth "B" and the third power of the local width "W" of the respective local portions of the respective gap.

Third definition

The improvement of the first definition; wherein the inner end of the gap and thereby of the extension face portion 51 meets the cylindrical configuration which is defined by the first radius 61 around the first axis 59, whereby the inner end of the gap provides a width which is equal to the width of the clerance between the the slide face 50 of said medial portion 55, 65 of the piston shoe 52 and the guide face portion 63 of the annular actuator guide face 63.

Fourth definition

The improvement of the third definition, wherein an interposed portion 500 of a slide face 50 is provided between the respective separating recess 57 of the separating recess 57 and the respective inner end of the respective gap of the gaps and the respective extension face 51, 65, 516 of the extension faces 51 on the respective piston shoe 52 of the piston shoes, whereby the interposed portion 500 of the slide face 50, 51 forms an inner elongation of the respective extension face 51, 65, 516 with the first radius 61 and thereby with an inclination relative to the extension face 51, 65, 516 of the second radius 62 in order to form an inner sealing land adjacent the the inner end of the respective extension face for the reduction of outflow of fluid from the gap of the gaps whereby a relative increase of the pressure in the gap is provided and the bearing capacity of said gap between the respective extension face 51, 65, 516 and the said respective portion of the annular guide face 63 of the actuator ring 40 is increased.

Regarding the arrangement of FIGS. 1 to 6 it is also of interest, that the piston is reciprocably mounted in the cylinder 100 of a rotor 101 as generally known from the former art. The guide face(s) 63 is (are) the inner face(s) of the stroke actuator 40 as also generally known from the former art. For a better understanding of the portion of the invention, which is subjected to the development of the hydrodynamic pressure field over the inclined face portions 51, a zero plane and an outer plane may be drawn from the second axis 58 radially through the rotor and the respective piston shoe portion. The distance between the second radius 62="r" and the first radius 61="R" is defined as 611=distance "d". This is the distance between the radius 61 of the general outer face of the hydrostatically action outer face portion of the piston shoe 52 and the radius of the extension face portions 51, 65, 516. This first radius is drawn around the first axis 59. Different therefrom is the eccentricity "e" between the axis of the rotor 101 and the piston stroke actuator 163. The eccentricity "e" is the distance between the first axis 59 and the third axis 102, which is the axis of the piston stroke actuator 40.

In order to secure proper entering of lubrication fluid into the very narrow gap between the respective extension face portion, also called, "the inclined face portion" 51 and the respective portion of the guide face(s) 63 it is preferred to fill the housing of the respective device with an exterior fluid. This is called "exterior" fluid, because it is not in communication with the pressurized interior fluid in the cylinder 100, passage 54 and fluid pocket(s) 55. The mentioned exterior fluid is commonly not pressurized. But it will act over the face portions 51 as described, if it is properly drawn into the field over the mentioned face portions 51. In order to obtain a maximum of hydrodynamic bearing capacity over the face portions 51 of the invention, it is preferred to provide between the respective inclined face portion 51 and the adjacent separating recess 57 a short interposed portion 500 of a radius equal to the radius 61, the first radius, of the medial main portion with pocket 55 of the piston shoe 52. This interposed portion prevents escape of fluid from the hydrodynamic pressure field over the face portion(s) 51 into the separating recess(es) 57. Thereby it makes it possible to obtain a maximum of pressure and thereby of bearing capacity over the face portion(s) 51 in the respective hydrodynamic pressure field thereover. Those peripherial end portions of the piston shoes, which form the face portions 51 for the obtainment of the desired pressure and bearing field over face portion(s) 51 is shown in FIG. 3 by the referential number 516; in FIG. 6 by 65; in FIG. 9 by 51 and in FIG. 10 by 1.

Figure 8:
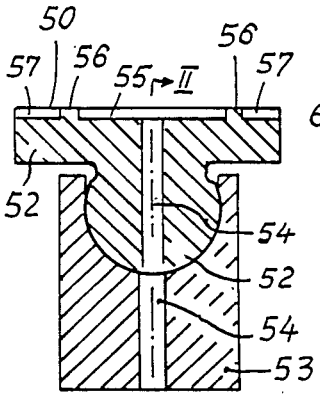
FIG. 8 corresponds to FIG. 2 and is a section through the medial face of FIG. 7.
Figure 7:
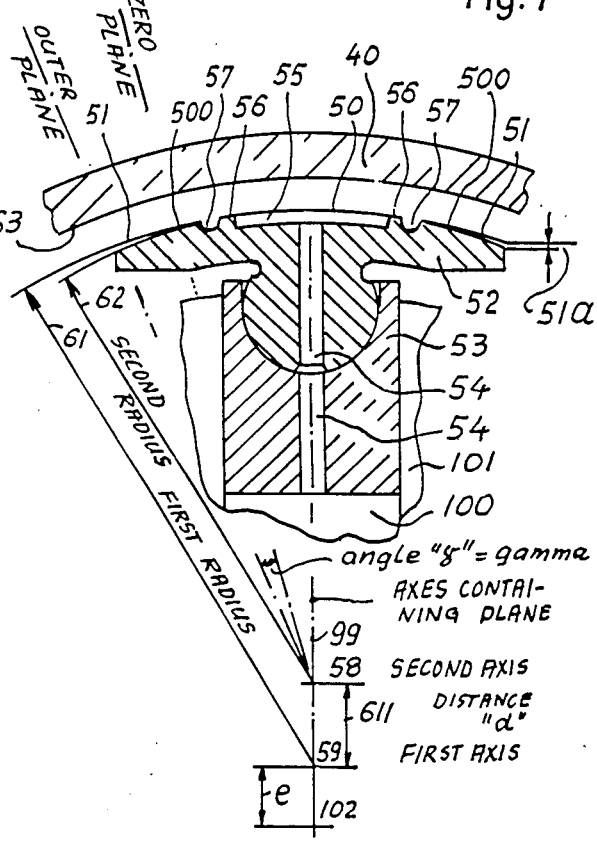
FIG. 7 is a sectional view through a portion of a device.
Figure 9:
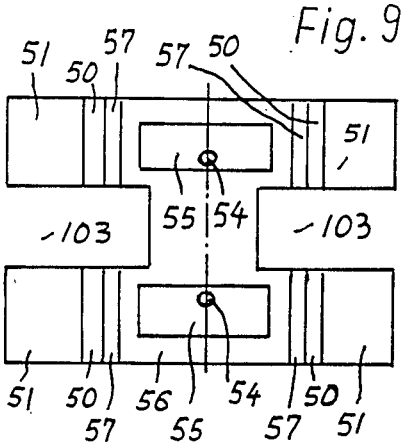
FIG. 9 is a view from above onto the shoe of FIG. 7.

FIGS. 7 to 9 show the matter of FIGS. 1 to 6 for the deep diving piston shoe. The referential numbers, their locations and actions are equal to those of FIGS. 1, 2 and 5. In FIG. 9 the recesses 103 between the lateral endportions of the shoe are shown and they define the characteristic of the deep diving piston shoe wherein the rotor's radial extensions between the cylinders enter the mentioned slots 103 in order to obtain the long piston stroke which is made possible by the deep diving piston shoe which has the recesses 103. FIG. 3 does not have these recesses and is therefore not a deep diving piston shoe but only an outer piston shoe which never enters into portions of a rotor and thereby remains a short stroke piston shoe.

FIGS. 7 to 9 are supplied in order to show the deep diving piston shoe in relative scale below the arrangement of FIG. 7. FIG. 8 is a sectional view through FIG. 7 along the dot-pointed medial vertical line in FIG. 7.

Figure 10:
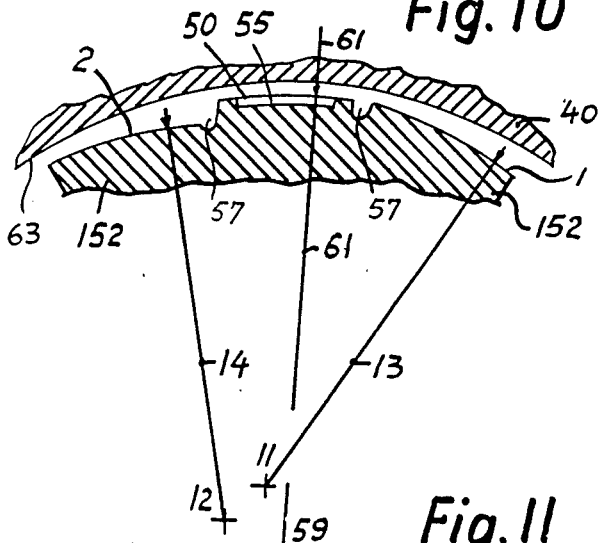
FIG. 10 is a sectional view through another embodiment of the invention.

FIG. 10 demonstrates in its right part an enlargement of a portion of FIGS. 2 and 7. In its left part the Figure demonstrates an oppositely inclined bearing portion 2.

The shoes of FIGS. 1 to 9 have an effective hydrodynamic bearing portion only in the forwardly directed half relative to the direction of movement of the piston shoe along the guide face 63.

Thus, FIG. 10 demonstrates a very effective piston shoe for a one directional rotation, namely for clockwise movement of the piston shoe in FIG. 10. Piston shoe 152 of FIG. 10, therefore, has a first inclined bearing face portion 1 on the front portion of the shoe and a second inclined face portion 2 on the rear portion of the piston shoe. The terms "front" and "rear" define the respective portion relative to the direction of movement of the piston shoe along the guide face 63 of the actuator ring 40. The front face portion 1 is formed by radius 13 around the axis 11, while the rear face portion 2 is formed by radius 14 around the axis 12. Axes 11 and 12 are distanced from each other but they are parallel to each other. They are so located and distanced from the axis 59 with radius 61 to the medial outer face portion of the piston shoe, that face portions 1 and 2 form in most cases equally long and wide face portions of equal relative inclination relative to the guide face 63 in equal direction of inclination relative to the direction of movement of the piston shoe along the guide face 63 of piston stroke guide body 40. The mentioned front face portion and rear face portion form each individually a front gap and a rear gap relative to the inner face 63 of the piston stroke guide 40.

Figure 11:
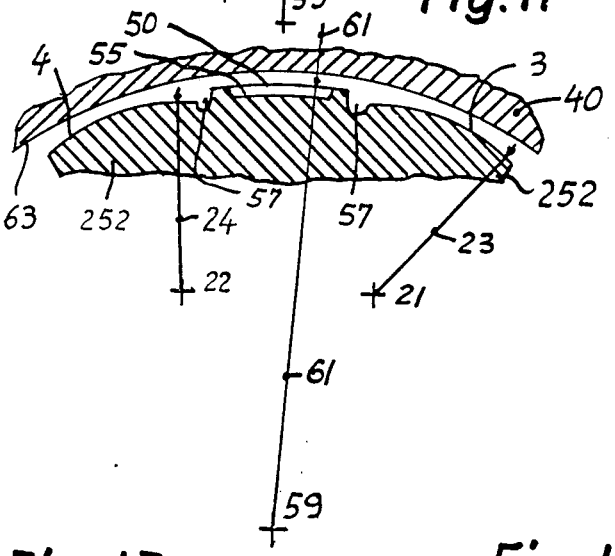
FIG. 11 is a sectional view through a still further embodiment of the invention.

FIG. 11 illustrates a modified piston shoe of FIGS. 2 and 7 for multidirectional movements of the piston shoe. The modified portions will now be discussed. Piston shoe 252 forms a front face portion 3 and a rear face portion 4. The front face portion 3 is formed by radius 23 around the axis 21. The rear face portion 24 is formed by radius 24 around the axis 22. Axes 21 and 22 are parallel to each other and parallel to axis 59, but distanced from each other and distanced from axis 59.

Axes 59 in FIGS. 10 and 11 are equal to the axis 59 of the other Figures wherein this axis appears. For substantial equal sizes of piston shoes of FIGS. 10 and 11, the radii 23 and 24 of FIG. 11 are substantially shorter than radii 13 and 14 in FIG. 10.

In FIG. 10 the inclined face portions 1 and 2 form on their entire length and width hydrodynamic bearing actions, when the piston shoe moves. In FIG. 11 however, roughly only half of the length, but the entire width of the inclined faces 3 and 4 are utilized to create hydrodynamic pressure fields, namely only the front portions of faces 3 and 4 seen in the direction of movement of the piston shoe 252. To make the faces 1 to 4 by radii around the mentioned axes is a way of example only. Other configurations could be applied if they could be machined and if they would create gaps which decrease between the shoe and the guide face 63 in the direction contrary to the direction of the movement of the piston shoe.

However, to make the faces as described in FIGS. 10 and 11 is recommended, because these configurations can be machined accurately enough, if a radius diamond cutter is available and if a surface grinder machine tool is built with two different spindles which revolve grinding wheels while stoppers are provided to set the piston shoes 152, 252 exactly into position below the grinding wheel for grinding by one of the wheels with a radius complementary to the first radius 61 the medial portion of the piston shoe outer face and with the second grinding wheel with a radius complementary to radii 13 and 14 or 23 and 24, respectively, the front portions and the rear portions 1 and 2 or 3 and 4 respectively.

Figure 13:
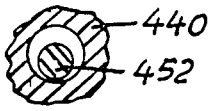
FIG. 13 is an explanational Figure for the calculation of FIG. 11.
Figure 12:
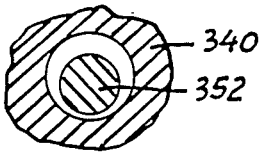
FIG. 12 is an explanation Figure for calculation of FIG. 10.

If the length of face portions 1 and 2 individually would be measured from the front gap to the rear gap and divided by "pi"=3.14, the face can become considered to be that of a cylindrical bar 352 of FIG. 12 in a cylindrical bearing bed of a sleeve 340. The bearing capacity of face 1 or 2 would then be about twice of the bearing capacity of a radial cylinder bearing of FIG. 12, when equal gaps and widthes (length of bearing 352-340) would be provided. Similarly, the faces 3 and 4 of FIG. 11 would give the radial cylinder bearing of FIG. 13. FIGS. 12 and 13 are in scale relative to FIGS. 10 and 11. For a first estimate of the bearing capacity of faces 1, 2, 3, 4 could at hand of FIGS. 12 or 13 respectively the following equation be used:

$$\boxed{p = \frac{\leqq 5d^2 b\eta}{h_o \psi}\,\omega} = \frac{1}{S}\ \frac{m^2 m}{m}\ \frac{Kgs}{m^2} = Kg \qquad (1)$$

with

P=bearing capacity in Kg; m=meter, d=diameter of bar 352 or of bar 452; dimension=m, b=length of the bar in the sleeve 340 or 440; dimension=m, $\eta$=viscosity of fluid in Kg s/m$^2$;

$h_o$=thickness of the respective rear gap; dimension=m

=relative bearing play=(D−d)/d with D=inner diameter of sleeve 340 or 440 and, $\omega$=rotary angular velocity in 1/s·S=seconds.

The equation might be used for a front gap about 10 times bigger than the rear gap. The rear gap would be smaller than 0,01 mm and be most only a few micron in pumps or motors with an inner diameter of guide face 63 of 80 to 200 mm. If a viscosity of 0.00252 Kg s/m$^2$ (average oil of 50 centigrade) would be used and if the relative speed between the face portion 1, 2, 3 or 4 and guide face 63 would be about 25 m/sec=25 meter per second, the bearing capacity of about 25 Kg per square-centimeter bearing face plus minus 15 Kg may become obtained. The big limit of 15 Kg plus or minus is given here, because the technology is a new field, for which not enough empiric values are available at the present time. More accurate data may appear in the future. This result is obtained, if the front gap would have been o,1mm for a peripherial length of 10 mm of the respective face portion 1, 2. 3 or 4.

Of importance is here, that the bearing capacity would become ten times higher if the front gap would be 10 times thinner. The bearing capacity is parallel to the reciprocal of the thickness of the front gap (in relation to the rear gap, whereby the rear gap must anyhow be very thin, as described.)

The above is a documentation therefore, that hydrodynamic bearing effects can be obtained only, if the specific sizes and configurations of the invention are used on the front and rear portions of piston shoes. It demonstrates further, that such effects can be obtained only, if the very small sizes are exactly made. These are so narrow and have such small limits, that presently no other ways of making them, are known, than those of the lapping or of the machining as described in this application.

The above analysis brings also specifically to light, that occasionally appearing remarks, that hydrodynamic effects are present, are often entirely untrue. Considering for example, that the mentioned French patent has only a point at the rear gap, that the angles of inclination periodically change, and that the bearing face is a portion of a ball, the above analysis clearly discloses, that such a means as that of the mentioned French patent can never obtain a single Kilogramm of bearing load over half a revolution of rotation of the rotor of the French patent which is mentioned under the prior art in this application.

While FIGS. 12 and 13 give a means to compare the effect of the faces 51, 1.2.3.4 with a commonly known hydrodynamic radial cylinder bearing, the inventor relies also on an analysis directly of the gap between the mentioned faces and the guide face 63.

Therein a number of radial faces are symbolically laid through the gap, which originate in the axis 59. They are called, when 5 planes are used, with the indices 1, 2, 3, 4 and 5.

The following is then considered:

$$\text{Inflow}=\text{Qin}=(\tfrac{1}{2})\delta_{in}LV \quad (2)$$

$$\text{Outflow}=\text{Qout}=(1/12\eta)\Delta p(B/L)\delta^3 \quad (3)$$

with

L=Length; B=breadth (width)

Q=fluid quantity and $\delta$=thickness of gap.

or:

$$\text{Qout}\approx(1/12\eta)(B/L)[P_1\delta_1{}^3+P_2\delta_2{}^3+P_3\delta^3+P_4\delta^3+\cdot P_5\delta^3] \quad (4)$$

or; roughly summarized:

$$\text{Qout}\approx(1/12\eta)(B/L)0{,}58P250^{-15}\delta\text{front} \quad (5)$$

whereafter Qin and Qout are set equal and the so obtained equation is transformed to P=Kg/cm$^2$ or Kg/m$^2$.

Both methods of estimates give about equal results presently. However, it should be recognized that they in fact are only estimates of the present time, which may obtain very considerable corrections when the knowledge in the art advances in the future. They give however already now a good impression thereabout, how accurate the machinings, dimensions, locations and configurations must be, when an effect shall be obtained. This demonstrates with overwhelming clarity, that such hydrodynamic bearing faces of piston shoes can become workable and effective only, if the of the invention are obeyed.

Recognized should also be, that the centrifugal forces which come from the masses of the pistons and shoes, are increasing parallel to the square power of the rotary angular velocity "$\omega$" while the bearing capacity increases only parallel to the rotary velocity $\omega$.

Thus, the present invention may increase the range of rotary angular velocity of the device by a few until about 20 percent, while unaccurate principles of the past, which were often only hoped for matters without basis in technology, could increase the speed range only a very few percent, or mostly, less than a single percent.

The fluid which is pressed from the cylinder into the pocket 55 of the hydrostatic bearing is considered to be the interior fluid. The fluid which is drawn onto the hydrodynamic bearing face portions of the invention is considered to be the exterior fluid and is commonly drawn into the gap from the interior of the housing. It is at the moment of drawing it into the gap mostly of low or of zero pressure.

Figure 15:
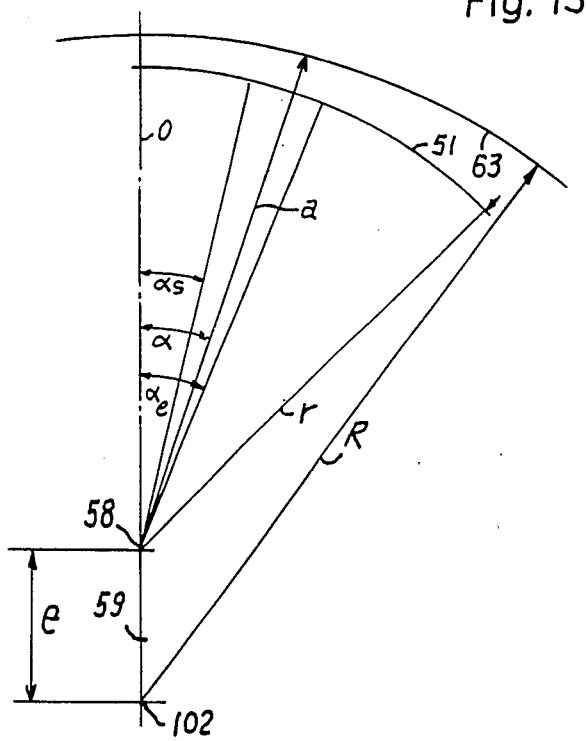
FIGS. 14 and 15 are mathematical schematics.
Figure 14:
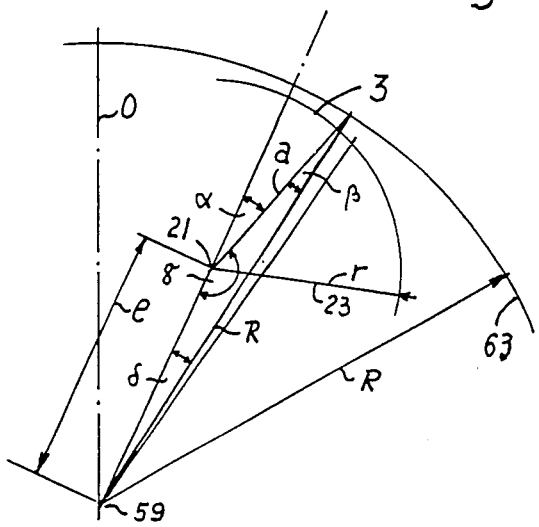

FIGS. 14 and 15 give the skeletons for further mathematical considerations.

FIG. 15 shows in principle the mathematically important values of FIGS. 1 or 7. The from the Figures known matters are indicated by referential numbers 51, 63, 58, 59 and 102. However, the value "e" in FIG. 15 is different from the value "e" in FIGS. 1 or 7. Note that in FIG. 15 the eccentricity "e" goes from 58 to 102. Outer face portion 51 has now the radius "r" around axis 58 and the piston stroke guide face 63 has the radius "R" around the axis 102. The medial thero plane "O" goes through the mentioned axes and defines the beginning of the respective angles. Angle "alpha s" is the inner end of the considered face portion 51, while the angle "alpha e" is the outer end of the respective face portion 51. It is now possible to calculate the radial size of the respective gap between the outer face 51 and the guide face 63 by setting any desired plane from axis 58 towards the guide face 63 with the respective angle "alpha". Such plane which is a straight line in the Figure, has the length "a" and this length goes from the axis 58 until the meeting with the piston stroke guide face 63. The difference "a minus r" is then the the radial size through the gap between faces 51 and 63 at the respective angle alpha. The length "a" does not need any mathematical development any more because this length is known to the public from the inventor's publications, such as U.S. Pat. No. 3,320,897 or from the inventor's lecture at the National Conference of Fluid Power of the USA of December 1984 at the Illionois Institute of Technology to be:

$$a = e \cos \alpha + R - (e^2/2R) \sin^2 \alpha \quad (6)$$

FIG. 15 gives all geometrical values which are to be used in this equation, namely "e" and "R". Alpha is selected at will for the calculation. The gap is then, as above mentioned,: "a-r".

FIG. 14 illustrates the geometrically important matters for the mathematical calculation of the respective gap in FIG. 11. The respective values are shown by referentials 21, 23, 3, 63 and 59. Note that the eccentricity "e" for the calculation now goes from referential axis 59 to axis 21 as the root of the radius "r"=23 of the slide face portion 3.

In this Figure the following geometric relations apply:

$$\frac{\sin\gamma}{R} = \frac{\sin\beta}{e} = \frac{\sin\delta}{a} \quad (7)$$

with:

$$\gamma = 180 - \alpha \quad (8)$$

$$\sin\beta = (e/R)\sin\gamma$$

$$\delta = 180 - \gamma - \beta$$

and:

$$a = e(\sin\delta/\sin\beta) \quad (9)$$

or $$a = R(\sin\delta/\sin\gamma) \quad (10)$$

Since by the above calculation the value of the length "a" has been found it is now easy to calculate the gap between the faces 3 and 63 again by: gap=a−r.

With the so obtained knowledge about the sizes of the gaps it is now easy to design an equivalent or semi equivalent FIG. 12 or 13 for the respective bearing portion of the outer face of the respective piston shoe. The bearing capacity can then be calculated by equation (1) for a first estimate.

For example, the length of face 3 (or of face 4) is to be set equal to the diameter of the shaft 452 of FIG. 13 multiplied by "$\pi$" with $\pi=3.14$. The difference of the diameters of shaft 452 and housing 440 of FIG. 13 is to be set equal to the maximum of the radial size of the gap (clearance) between the faces 63 and 3 (or 63 and 4) of FIG. 11. This maximum of the mentioned radial size exists at the peripherial ends of the mentioned face 3 (or 4) in FIG. 11. The radius 23 of FIGS. 11 and 14 is then equal to the half of the diameter of the revolving shaft 452 in the bearing housing 440 of the hydrodynamic radial bearing of FIG. 13 of the known and common hydrodynamic radial bearings of the former art. Since these bearings of the former art are still presently widely in use and calculable from the respective presently available literature, all respective calculations and designs of devices can be carried out.

For the actual design of the respective pump or motor it is suggested to built respective piston shoes with respective sizes and to find the rotary speed of the rotor and the pressure in the fluid in the device at which the outer faces start welding or show signs of wear. The useable range is then that speed and pressure at which still no welding or wearing between the mentioned outer faces of the piston shoes and the piston stroke guide face 63 appears.

Equation (1) is taken and transformed from "Grundlagen der Lager-schmierung", page 89, published by "Verlangsanstalt Huething and Dreyer GmbH, Mainz and Heidelberg" (Copyright 1959). The equation gives a simplified method for usual calculation of whether a radial hydrodynamic bearing will bear the borne member or weld. For more exact calculations the literature which is mentioned in this specification may be consulted.

What is claimed is:

1. An improvement on outer slide faces of piston shoes in radial piston fluid flow facilitating devices, such as pumps, motors, compressors, transmissions, wherein said slide faces are the radial end faces of the piston shoes and are sliding along at least one respective guide face(s) of the piston stroke actuator of the device, while said guide face(s) is (are) of cylindrical configuration of a first radius around a first axis and thereby an annular guide face, said outer faces are at least partially substantially complementary configurated respective to portions of said annular guide face and wherein said slide faces of said piston shoes are interrupted by recesses which form fluid pressure pockets which are filled with an interior fluid from fluid containing cylinders through passages to constitute with their surrounding sealing lands hydrostatic bearing portions and said improvement comprising a curvature, wherein said slide faces form medial portions which contain said hydrostatic bearings and are substantially part-cylindrical with said first radius around said first axis, wherein said slide faces and piston shoes have a pair of extensions at opposite ends of said medial portions in the direction of the movements of said piston shoes, wherein separating recesses are provided between said sealing lands of said hydrostatic bearings and said extensions, wherein said extensions form bearing face portions with front face portions and rear face portions and gaps between said bearing face portions and respective portions of said guide face with front gap portions and rear gap portions, wherein said front end portions and front gap portions are in the front direction of the movement of the shoe while said rear end portions and rear gap portions are rearward respectively to said front face portions and said front gap portions;

wherein said front face portions and said rear face portions form inclined face portions on both peripherial ends of said front and rear face portions to form hydrodynamic bearing face portions for multidirectional movements of said piston shoes, whereby each of said front and rear face portions draws an exterior fluid into said front gap portions of said front and rear face portions at forwardly directed movements of said piston shoes and into said rear gap portions of said front and rear face portions at rearwardly directed movements of said piston shoes;

wherein said front face portions and said rear face portions form substantially equally sized and configurated but oppositely directed curved face portions with bearing face radii around first and second bearing face axes which are distanced in opposite directions from the vertical medial plane through the respective piston shoe, which are substantially equally distanced from the respective portion of said guide face and which are parallel to said first axis but distanced therefrom, and , wherein said bearing face radii are considerably shorter than said first radius around said first axis to form part cylindrical face portions to constitute said front and rear face portions, whereby said front and rear face portions form narrow gap portions substantially in the middle between the front end and rear end of the respective face portion while each front end and rear end of the respective face portion forms thereover a wider gap to form hydrodynamic pressure field bearing face portions before and behind said middle and said narrow gap to draw in fluid through the respective wider gap of the respective end of the respective face portion of said front and rear face portions when said piston shoes move in one of the forward and rearward directions along said guide face, whereby said front and rear face portions form hydrodynamic pressure fields before said medial narrow gaps at forward movements of said piston shoes and hydrodynamic pressure fields rearwards of said narrow gaps at rearwards directed movements of said piston shoes.

2. The improvement of claim 1, wherein halves of the lengthes in movement direction of said front and rear face portions create bearing fields in one movement direction and the other halves of said lengthes create pressure fields in the other movement direction.

3. An improvement on the outer slide faces of piston shoes in radial piston fluid flow facilitating devices, such as pumps, motors, compressors, transmissions, wherein said slide faces are the radial end faces of the piston shoes and are sliding along at least one respective guide face(s) of the piston stroke actuator of the device, while said guide face(s) is (are) of cylindrical configuration of a first radius around a first axis and thereby an annular guide face, said outer faces are at least partially substantially complementary configurated respective to portions of said annular guide face and wherein said slide faces of said piston shoes are interrupted by recesses which form fluid pressure pockets which are filled with an interior fluid from fluid containing cylinders through passages to constitute with their surrounding sealing lands hydrostatic bearing portions and said improvement comprising a curvature, wherein said slide faces form medial portions which contain said hydrostatic bearings and are substantially part-cylindrical with said first radius around said first axis, wherein said slide faces and piston shoes have a pair of extensions at opposite ends of said medial portions in the direction of the movements of said piston shoes, wherein separating recesses are provided between said sealing lands of said hydrostatic bearings and said extensions, wherein said extensions form bearing face portions with front face portions and rear face portions and gaps between said bearing face portions and respective portions of said guide face with front gap portions and rear gap portions, wherein said front end portions and front gap portions are in the front direction of the movement of the shoe while said rear end portions and rear gap portions are rearward respectively to said front face portions and said front gap portions;

wherein said front face portions and said rear face portions form inclined curved face portions on both peripherial ends of said front and rear face portions to form hydrodynamic bearing face portions for multidirectional movements of said piston shoes, whereby each of said front and rear face portions draws an exterior fluid into said front gap portions of said front and rear face portions at forwardly directed movements of said piston shoes and into said rear gap portions of said front and rear face portions at rearwardly directed movements of said piston shoes, wherein said front face portions and said rear face portions form substantially equally sized and configurated but oppositely directed curved face portions with bearing face radii around said first and second bearing face axes which are distanced in opposite directions from the vertical medial plane through the respective piston shoe, which are substantially equally distanced from the respective portion of said guide face and which are parallel to said first axis but distanced therefrom, and , wherein said bearing face radii are considerably shorter than said first radius around said first axis to form part cylindrical face portions to constitute said front and rear face portions, whereby said front and rear face portions form narrow gap portions substantially in the middle between the front end and rear end of the respective face portion while each front end and rear end of the respective face portion forms thereover a wider gap to form hydrodynamic pressure field bearing face portions before and behind said middle and said narrow gap to draw in fluid through the respective wider gap of the respective end of the respective face portion of said front and rear face portions when said piston shoes move in one of the forward and rearward directions along said guide face, whereby said front and rear face portions form hydrodynamic pressure fields before said medial narrow gaps at forward movements of said piston shoes and hydrodynamic pressure fields rearwards of said narrow gaps at rearwards directed movements of said piston shoes, and;

whereby said piston shoes form multidirectional hydrodynamic bearing shoes for forewards and rearwards directed movements of said piston shoes by said curved face portions with said bearing face radii by the extension of said curved face portions equally symmetrical in both peripheral directions away from said middle between the front and rear ends of said respective face portion.

* * * * *